US010179632B2

(12) United States Patent
Taylor

(10) Patent No.: US 10,179,632 B2
(45) Date of Patent: Jan. 15, 2019

(54) BOAT APPARATUS FOR PRODUCING A SURF WAKE

(71) Applicant: Guy Taylor, Duchesne, UT (US)

(72) Inventor: Guy Taylor, Duchesne, UT (US)

(73) Assignee: 3PO BOAT ACCESSORIES, LLC, Duchesne, UT (US)

( * ) Notice: Subject to any disclaimer, the term of this patent is extended or adjusted under 35 U.S.C. 154(b) by 503 days.

(21) Appl. No.: 15/148,850

(22) Filed: May 6, 2016

(65) Prior Publication Data

US 2017/0320552 A1 Nov. 9, 2017

(51) Int. Cl.

| | |
|---|---|
| ***B63B 35/85*** | (2006.01) |
| ***B63H 20/02*** | (2006.01) |
| ***B63H 25/44*** | (2006.01) |
| ***B63H 25/48*** | (2006.01) |

(52) U.S. Cl.

CPC ..... *B63B 35/85* (2013.01); *B63H 20/02* (2013.01); *B63H 25/44* (2013.01); *B63H 25/48* (2013.01); *B63B 2035/855* (2013.01)

(58) Field of Classification Search

CPC ..... B63H 5/16; B63H 25/44; B63H 25/48
USPC ..... 114/145 A, 280, 282, 285; 440/71
See application file for complete search history.

(56) References Cited

U.S. PATENT DOCUMENTS

| | | | | |
|---|---|---|---|---|
| 5,127,353 A * | 7/1992 | Wieser | B63H 25/50 | 114/145 A |
| 5,493,990 A * | 2/1996 | Dyer | B63H 25/44 | 114/145 A |
| 5,711,241 A * | 1/1998 | Dyer | B63H 25/50 | 114/145 A |
| 6,161,492 A * | 12/2000 | Dyer | B63H 25/44 | 114/145 A |
| 8,257,121 B2 * | 9/2012 | Taylor | B63H 5/165 | 440/71 |
| 8,468,964 B2 * | 6/2013 | Hoberman | B63H 25/48 | 114/145 R |
| 8,474,391 B1 * | 7/2013 | Hagen | B63H 25/44 | 114/145 A |

* cited by examiner

*Primary Examiner* — Lars A Olson
(74) *Attorney, Agent, or Firm* — Kirton McConkie; Evan R. Witt

(57) ABSTRACT

A boat propeller apparatus can be coupled to virtually any motor boat to cause the boat to safely and efficiently produce a surfable wake. The boat propeller apparatus can be configured to mount to the boat in a way that causes the apparatus to be positioned and secured behind but spaced from the propeller while the boat is moving forward. The apparatus will therefore be in the path of the propelled water and will function to divert the propelled water in such a way as to create a larger/taller wake than would otherwise be produced by the boat. The boat propeller apparatus can also function as a propeller shield and be used in conjunction with a propeller guard.

20 Claims, 7 Drawing Sheets

BOAT APPARATUS FOR PRODUCING A SURF WAKE

CROSS-REFERENCE TO RELATED APPLICATION

N/A

BACKGROUND OF THE INVENTION

1. Field of the Invention

The present invention relates generally to an apparatus for use on a boat to cause the boat to generate a taller wake. More particularly, the apparatus of the present invention can be installed on virtually any standard outboard or inboard/outboard sterndrive motor boat to cause the motor boat to produce a surf wake.

2. Background and Related Art

Wakesurfing, or surfing on the wake produced by a boat, has recently become a popular sport. While wakesurfing, the rider trails behind the boat riding the wake without being pulled directly by the boat. Because the rider is not pulled by the boat, he or she must typically be in close proximity to the boat (typically between 8 and 10 feet from the boat) where the wake is sufficiently steep to propel the rider forward.

Because the rider is so close to the boat, it is typically not recommended to wakesurf behind an outboard or an inboard/outboard boat since the propeller on such boats is exposed. However, various propeller guards have been created to prevent the rider from coming in contact with the propeller. See, for example, U.S. Pat. Nos. 5,098,321 and 6,159,062. Propeller shields have also been developed to provide additional safety and protection from unintended contact with the propeller. An example of a propeller shield that can be employed on an outboard or an inboard/outboard boat is disclosed in U.S. Pat. No. 8,257,121 (the '121 Patent).

FIG. 1 illustrates the prior art propeller shield 10 that is disclosed in the '121 Patent. As shown, propeller shield 10 is designed to pivot over and away from the distal face of a propeller 100 (or the portion of the propeller that faces away from the boat's bow) depending on the speed and the direction in which the boat is moving through water. When the boat is at rest or moving backwards, propeller shield 10 will remain in the position shown in FIG. 1. In contrast, as the boat moves forward, propeller shield 10 will pivot upwardly until the speed of the boat causes propeller shield 10 to ride at or on the surface of the water.

Propeller shield 10 includes a shield member 15 that is shaped and sized to overlap a propeller guard 25 that extends around propeller 100. Therefore, shield member 15 will contact propeller guard 25 to prevent propeller shield 10 from contacting propeller 100. Shield member 15 can include a number of openings 30 which will allow some water to flow through shield member 15 so that propeller shield 10 will only pivot upwardly when the boat moves at a sufficient speed in the forward direction. Openings 30 can also minimize the impact of having propeller shield 10 overtop propeller 100 when the boat is moving in reverse.

In FIG. 1, propeller shield 10 is connected to the hydraulic connection point 45 on an outdrive motor 200 via connection mechanism 20. This connection can be configured as a pivoting connection to allow propeller shield 10 to freely pivot between the position shown in FIG. 1 and a raised position (not shown). Shield member 15 may also include an indentation 27 to allow it to pivot around an anti-ventilation plate 205 on the motor's outdrive unit 200.

The combination of propeller shield 10 and propeller guard 25 can substantially eliminate the likelihood that a rider will come in contact with propeller 100. Accordingly, by employing propeller shield 10 in conjunction with propeller guard 25, an outboard boat can potentially be used for wakesurfing. However, even with a propeller shield to protect the rider from the propeller, many motor boats will still not be suitable for wakesurfing—at least without modifications.

To produce a suitable wake, it is desirable to have as much weight as possible towards the rear of the boat. Also, because only one side of the wake will be surfed, it is also desirable to weight one side of the boat more than the other so that the boat will ride somewhat on its side thereby producing a larger wake on that side. Various techniques have been employed to weight typical motor boats to cause them to produce suitable wakes. However, these techniques can be expensive and/or dangerous. In particular, because the boat is heavily weighted at the rear on one side, the weighted side will sit lower in the water than the rest of the boat. A weighted boat will therefore be much more likely to take on water and even sink or overturn.

Therefore, to be able to wakesurf in a safe manner, it is typically required to invest in a specialized boat that is specifically configured to produce a surfable wake. However, few if any options exist for modifying a standard outboard or inboard/outboard sterndrive motor boat to safely produce a surfable wake.

BRIEF SUMMARY OF THE INVENTION

The present invention extends generally to a boat propeller apparatus that can be coupled to virtually any motor boat to cause the boat to safely and efficiently produce a surfable wake. The boat propeller apparatus of the present invention can be configured to mount to the boat's motor (or to another structure of the boat) in a way that causes the apparatus to be positioned and secured behind but spaced from the propeller while the boat is moving forward. The apparatus will therefore be in the path of the propelled water and will function to divert the propelled water in such a way as to create a larger/taller wake than would otherwise be produced by the boat.

The boat propeller apparatus of the present invention can also function as a propeller shield and be used in conjunction with a propeller guard. When the propeller apparatus is used in conjunction with a propeller guard, the propeller guard can funnel water towards the apparatus thereby increasing the amount of water that is diverted around the apparatus and enhancing the size of the wake.

In one embodiment, a propeller apparatus for enhancing the size of the wake produced by a motor boat can comprise a propeller shield that is sized and shaped to cover a distal face of a boat propeller; a connection mechanism that couples the propeller shield to the boat via a pivoting connection thereby allowing the propeller shield to pivot between a shielded position in which the propeller shield covers the distal face of the boat propeller and a raised position in which the propeller shield rides at or on the surface of the water; wings which extend outwardly from opposing sides of the propeller shield; and a connecting member for retaining the propeller shield in a plow position, the plow position being between the shielded position and the raised position such that propeller shield remains behind and substantially inline with the propeller.

In another embodiment, a propeller apparatus for enhancing the size of the wake produced by a motor boat can comprise: a propeller guard that is configured to extend around a boat propeller; a propeller shield that is sized and shaped to overlap the propeller guard; a connection mechanism that couples the propeller shield to the boat via a pivoting connection thereby allowing the propeller shield to pivot between a shielded position in which the propeller shield is adjacent the propeller guard and a raised position in which the propeller shield rides at or on the surface of the water; wings which extend outwardly from opposing sides of the propeller shield; and a connecting member for retaining the propeller shield in a plow position, the plow position being between the shielded position and the raised position such that propeller shield remains behind and substantially inline with the propeller.

In another embodiment, a propeller apparatus for enhancing the size of the wake produced by a motor boat can comprise: a propeller shield that is sized and shaped to cover a distal face of a boat propeller; a connection mechanism that couples the propeller shield to the boat via a pivoting connection thereby allowing the propeller shield to pivot between a shielded position in which the propeller shield covers the distal face of the boat propeller and a raised position in which the propeller shield rides at or on the surface of the water; wings which extend outwardly from opposing sides of the propeller shield; and a connecting member that is configured to selectively limit the upward pivoting of the propeller shield to thereby retain the propeller shield in a plow position in which the propeller shield is spaced from but inline with the propeller.

These features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained and will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner and in one or more embodiments. In the following description, numerous specific details are provided, such as examples of suitable propeller shields, components, materials, apparatus, processes, methods, etc., to provide a thorough understanding of embodiments of the invention. One skilled in the relevant art will recognize, however, that the invention may be practiced without one or more of the specific details or methods, or with other methods, components, characteristics, materials, and so forth. In other instances, well-known structures, materials, or operations are not shown or described in detail to avoid obscuring aspects of the invention.

The embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of the embodiments of the propeller apparatus as represented in FIGS. 2A through 5, 7A and 7B, is not intended to limit the scope of the invention, as claimed, but is merely representative of some embodiments of the invention.

Figure 1:
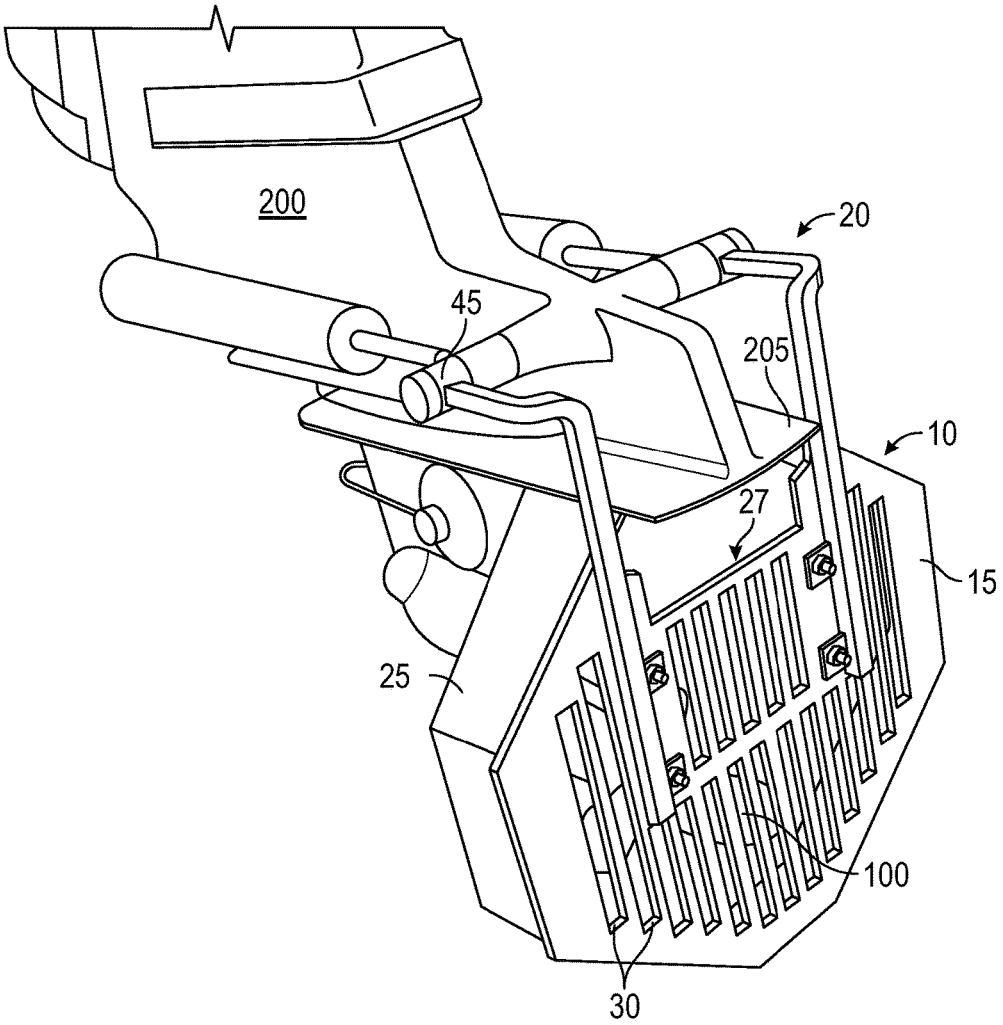
FIG. 1 (Prior Art)
FIG. 1 illustrates a prior art propeller shield.
Figure 2A:
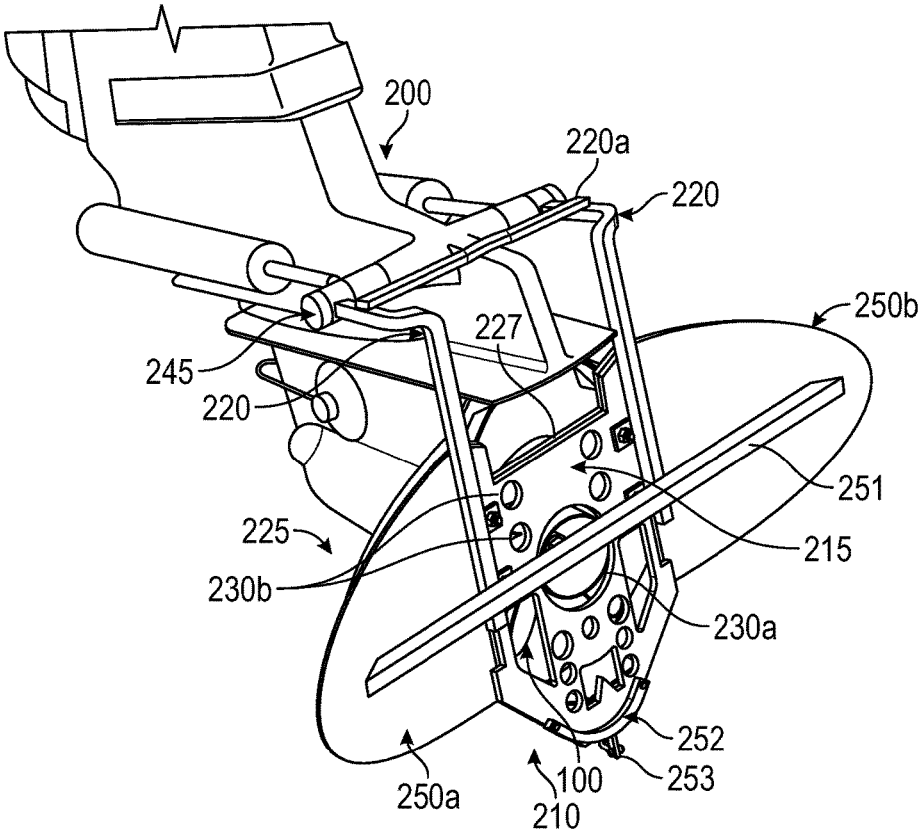
FIG. 2A illustrates a propeller apparatus in accordance with embodiments of the present invention when the propeller apparatus is in a downward or shielded position.
Figure 2B:
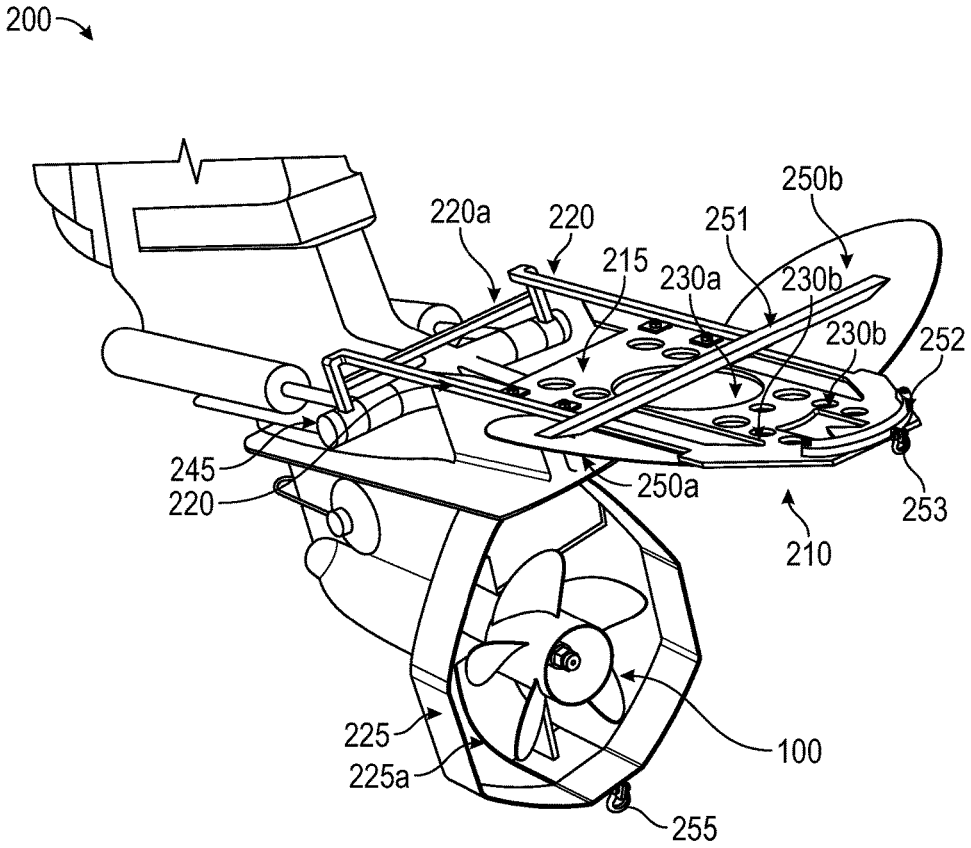
FIG. 2B illustrates the propeller apparatus when in a raised position.

FIGS. 2A and 2B illustrate a propeller apparatus 210 in accordance with embodiments of the present invention in a lowered (or shielded) position and a raised position respectively. In these two positions, propeller apparatus 210 can function in a similar manner as propeller shield 10 described in the '121 Patent. In particular, propeller apparatus 210 can include a shield member 215 that is configured and sized to substantially overlap propeller guard 225 (not visible in FIG. 2A) that extends around propeller 100. Propeller apparatus 210 can be configured to couple to motor 200 via a pivoting connection to allow propeller apparatus 210 to pivot between the positions shown in FIGS. 2A and 2B. For example, a connection mechanism 220 consisting of parallel bars can be configured to couple to hydraulic connection point 45. In some embodiments, and for reasons that will become apparent below, a reinforcing bar 220*a* can extend between the parallel bars of connection mechanism 220. Of course, other types of connection mechanisms can be employed to adapt propeller apparatus 220 to the different types of motor/boat designs as long as the connection mechanism couples propeller apparatus 210 in a pivoting manner.

In normal operation, propeller apparatus 210 can be allowed to freely pivot between the lowered and raised positions shown in FIGS. 2A and 2B. Therefore, when the boat is stationary, moving slowly forward, or moving backwards, propeller shield 215 will remain overtop the distal face of propeller 100 thereby preventing an individual from contacting the propeller. In contrast, as the boat moves forward at greater speeds, propeller apparatus 210 will pivot upwardly to ride at or on the surface of the water thereby minimizing the drag that the propeller apparatus may cause.

In addition to functioning as a propeller shield, propeller apparatus 210 can also function as a wake enhancer to enable virtually any type of outboard or inboard/outboard sterndrive motor boat to produce a surfable wake. To enhance the wake, propeller apparatus 210 can be maintained in a lowered (or "plow") position while the boat moves forward such that propeller shield 215 remains substantially behind propeller 100. Therefore, water passing through propeller 100 will be directed against propeller shield 215. Propeller shield 215 can include openings, including a larger central opening 230*a* and a number of smaller openings 230*b* around central opening 230*a*, which will allow some water to pass through propeller shield 215.

Figure 6:
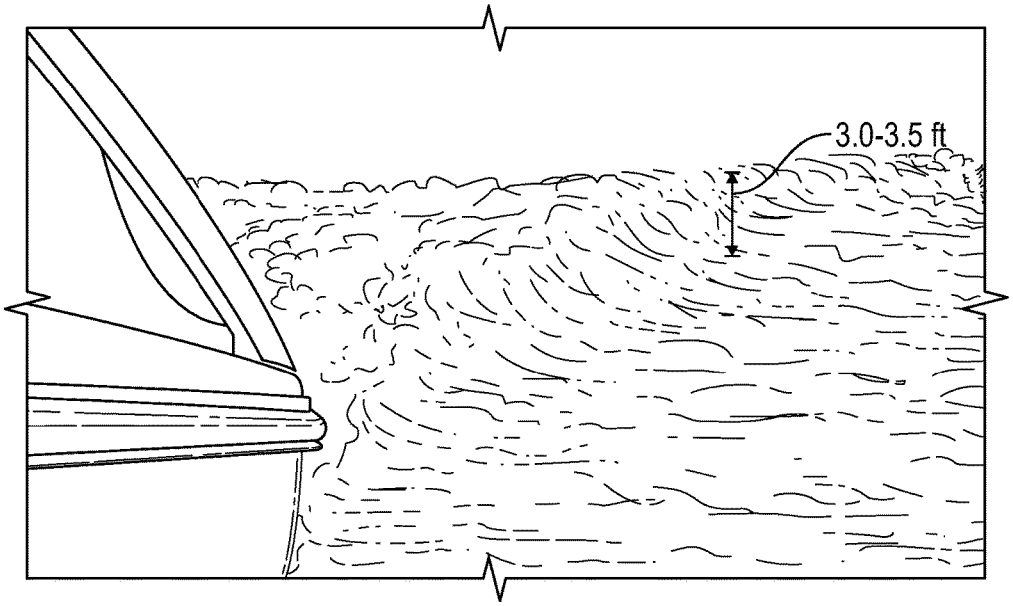
FIG. 6 illustrates an example of a surfable wake that can be produced by employing the propeller apparatus on a standard motor boat.

Propeller apparatus 210 includes wings 250*a* and 250*b* which extend outwardly and rearwardly from propeller shield 215. Wings 250*a* and 250*b* provide a surface area for diverting water around propeller apparatus 210 as the boat moves in a forward direction. The outward and rearward shape of wings 250*a* and 250*b* can facilitate the diversion or redirection of the water without unduly increasing drag. Although the physics behind the invention are not fully understood at this time, it is believed that by positioning propeller apparatus 210 directly behind propeller 100 with wings 250*a* and 250*b* extending outwardly beyond propeller 100, a similar effect is achieved as if the boat had been weighted to cause it to sit lower in the water. As mentioned above, in conventional wake surf boats, the lower the rear of the boat sits in the water, the higher the wake that will be produced. However, the propeller apparatus of the present invention has been found to produce a taller or higher wake (such as is shown in FIG. 6) without needing to weigh down the rear of the boat, thereby enabling a surfable wake to be produced without any costly and dangerous modifications to the structure of the boat. Also, when employing the propeller apparatus of the disclosed invention, the size and shape of the wake may be adjusted by adjusting the trim of the outboard motor.

Because a large amount of force will be applied against wings 250*a* and 250*b* while the boat is moving, a reinforcing bar 251 may be coupled to and extend between wings 250*a* and 250*b*. Reinforcing bar 251 can restrict any relative rearward movement of wings 250*a* and 250*b* with respect to propeller shield 215. As mentioned above, reinforcing bar 220*a* can be coupled to and extend between the parallel bars of connection mechanism 220 to provide additional reinforcement to connection mechanism 220 when propeller apparatus 210 is used in the plow position to enhance the wake.

Figure 3A:
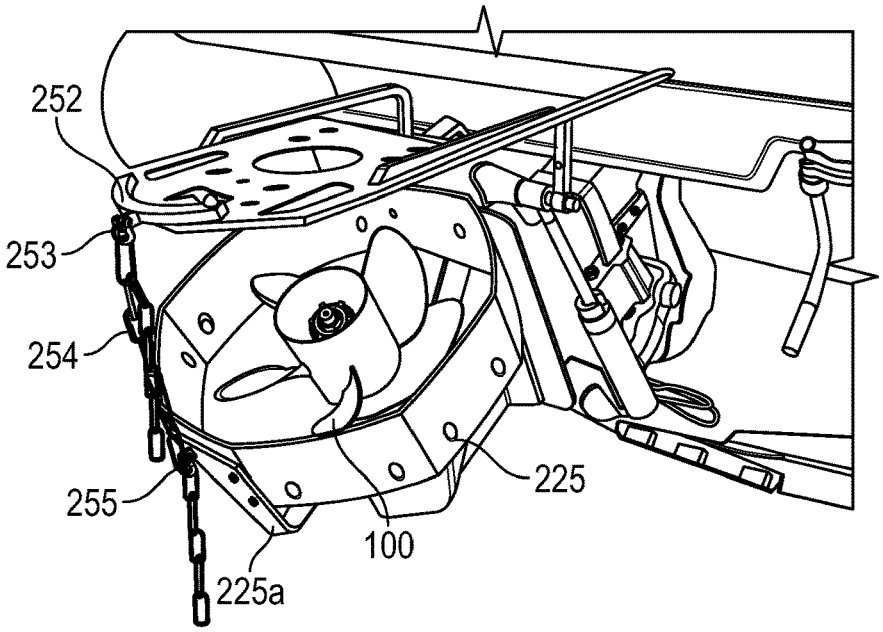
FIGS. 3A and 3B illustrate an example of how the propeller apparatus can be retained in a plow position when the boat is moving in a forward direction.
Figure 3B:
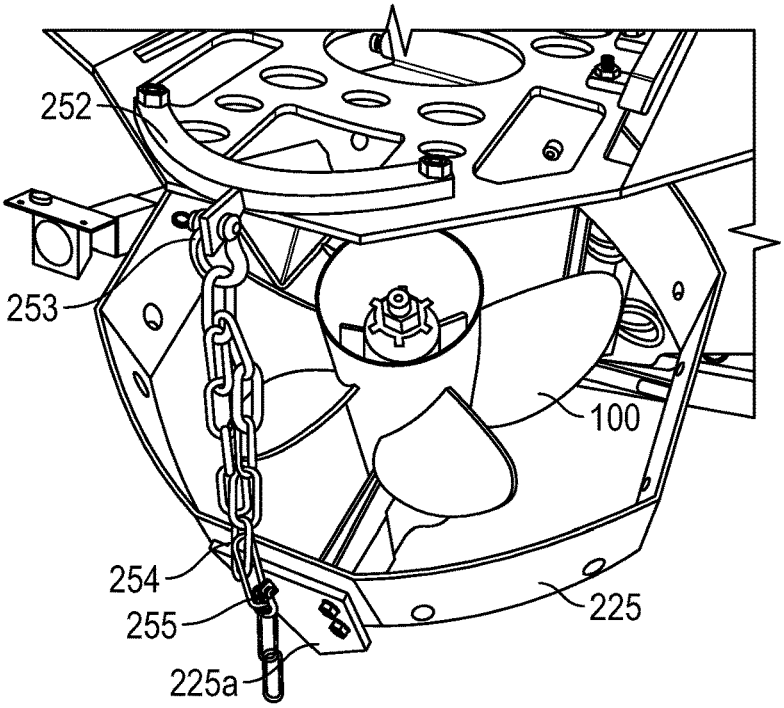

As described above, propeller apparatus 210 can be configured to function as a propeller shield that pivots upwardly to ride on or at the surface of the water when it is not desired to enhance the wake. In contrast, once it is desired to enhance the wake, propeller apparatus 210 can be prevented from pivoting fully upwardly so that propeller shield 215 remains substantially behind propeller 100. Various mechanisms can be employed to secure propeller shield 215 in this "plow" position. FIGS. 3A and 3B best illustrate one example of a suitable mechanism.

As shown in FIGS. 3A and 3B, propeller guard 225 can be coupled to motor 200 via a bracket 225*a* that extends between a bottom of propeller guard 225 and motor 200. A distal end of bracket 225*a* can be positioned at or near a bottom and distal edge of propeller guard 225 and can include a connecting structure 255. A reinforcing member 252 may be located at a bottom edge of propeller shield 215 and may also include a connecting structure 253. Connecting structures 253 and 255 can be any suitable structure for coupling a connecting member 254 between propeller shield 215 and propeller guard 225. For example, in the depicted embodiments, connecting member 254 is a chain and one or both of connecting structures 253 and 255 may be an anchor shackle, quick link, carabiner, or other type of chain connector that will allow the chain to be quickly disconnected from at least one of connecting structures 253 and 255. Preferably, connecting member 254 will be configured to disconnect from both connecting structures so that it will not remain in the water where it may come in contact with propeller 100.

Figure 5:
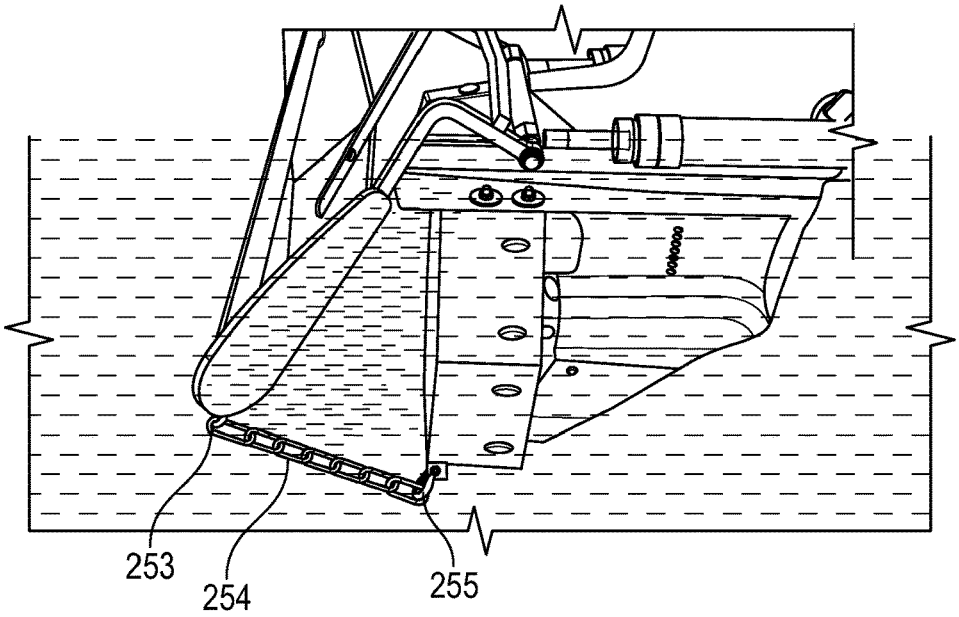
FIG. 5 illustrates the propeller apparatus in the plow position.

The length of connecting member 254 that extends between connecting structures 253 and 255 can be configured to ensure that propeller shield 215 will remain behind (or inline with) propeller 100 even when the boat is moving forward at higher speeds. In other words, connecting member 254 can have a length that causes propeller shield 215 to remain in the plow position during forward movement of the boat. FIG. 5 illustrates an example of propeller shield 215 in this plow position. For example, connecting member 254 (or at least the portion of connecting member 254 that extends between connecting structures 253 and 255) can have a length between 5 and 10 inches so that the bottom edge of propeller shield 215 is able to pivot backwardly and slightly upwardly away from propeller guard 225.

Figure 4:
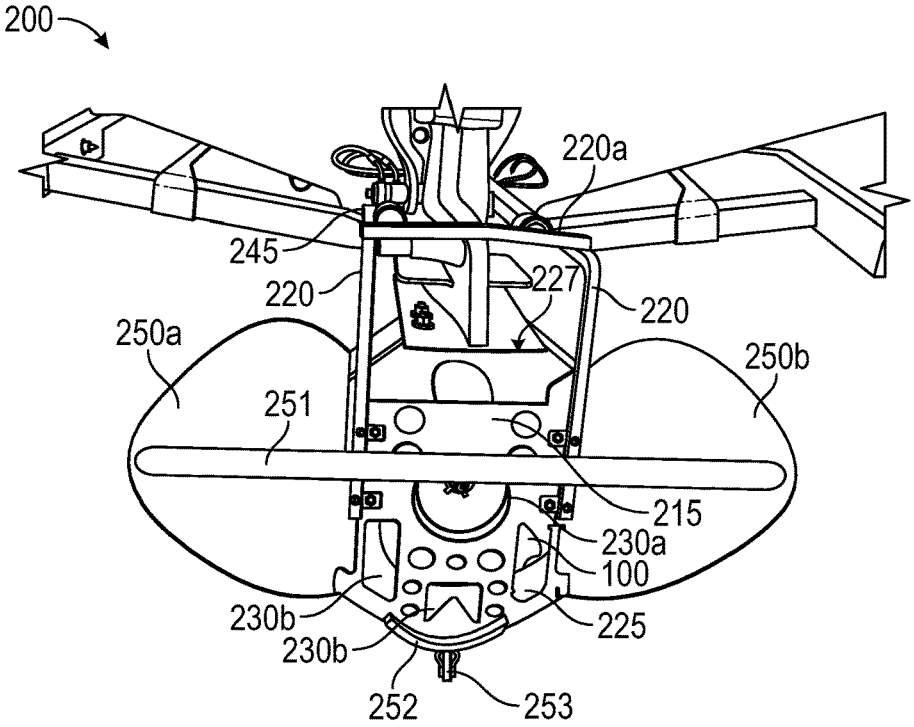
FIG. 4 illustrates a rear view of the propeller apparatus when in the shielded position.

By retaining propeller shield 215 in this plow position, water propelled by propeller 100 will be directed against and around propeller shield 215 and wings 250*a* and 250*b* resulting in the creation of a taller or higher wake. Allowing propeller shield 215 to pivot slightly (e.g., between 5 and 10 inches at the connecting structure 253) into the plow position can ensure that propeller apparatus 210 does not produce too much drag. As is best seen in FIG. 4, wings 250*a* and 250*b* can extend substantially beyond the outer edges of propeller guard 225 to thereby create a substantial surface area for diverting water. As is also best seen in FIG. 4, openings 230*a* and 230*b* can allow some water to bypass propeller shield 215 so as to not overly inhibit propulsion of the boat.

Accordingly, propeller apparatus 210 can be selectively used as only a propeller shield or as both a propeller shield and a wake enhancer by simply coupling connecting member 254 between connecting structures 253 and 255 when it is desired to enhance the wake. Of course, the use of connecting member 254 is only one example of how propeller shield 215 can be retained in the plow position. Other mechanisms may equally be employed. For example, connection mechanism 220 could be coupled to motor 200 or another portion of the boat via a hydraulic or other type of actuator that would allow propeller shield 215 to be retained in the plow position when desired. Alternatively, an adjustable structure may be positionable above connection mechanism 220 to limit the extent to which propeller apparatus can pivot upwardly. It is noted, however, that a primary benefit of coupling connecting member 254 between bracket 225*a* and reinforcing member 252 is that propeller shield 215 will be restrained at the location where the rearward force will be greatest (i.e., at the bottom edge of propeller shield 215).

Therefore, connecting member 254 will facilitate reinforcing and retaining propeller shield 215 at this location (e.g., to minimize the likelihood that propeller shield 215 will become bent). It is also noted that the use of reinforcing bar 251 will reinforce wings 250*a* and 250*b* at their edges where the rearward force will be greatest.

It is further noted that, in some embodiments, propeller apparatus 210 could be used without propeller guard 225 (e.g., in conjunction with other structural or mechanical features that would prevent propeller shield 215 from contacting propeller 100). However, combining propeller guard 225 with propeller apparatus 210 has proven to increase the enhancement of the wake caused by propeller apparatus 210. It is believed that this is due to propeller guard 225 funneling water towards propeller shield 215 to thereby increase the amount of water that is diverted around wings 250*a* and 250*b*.

Figure 7A:
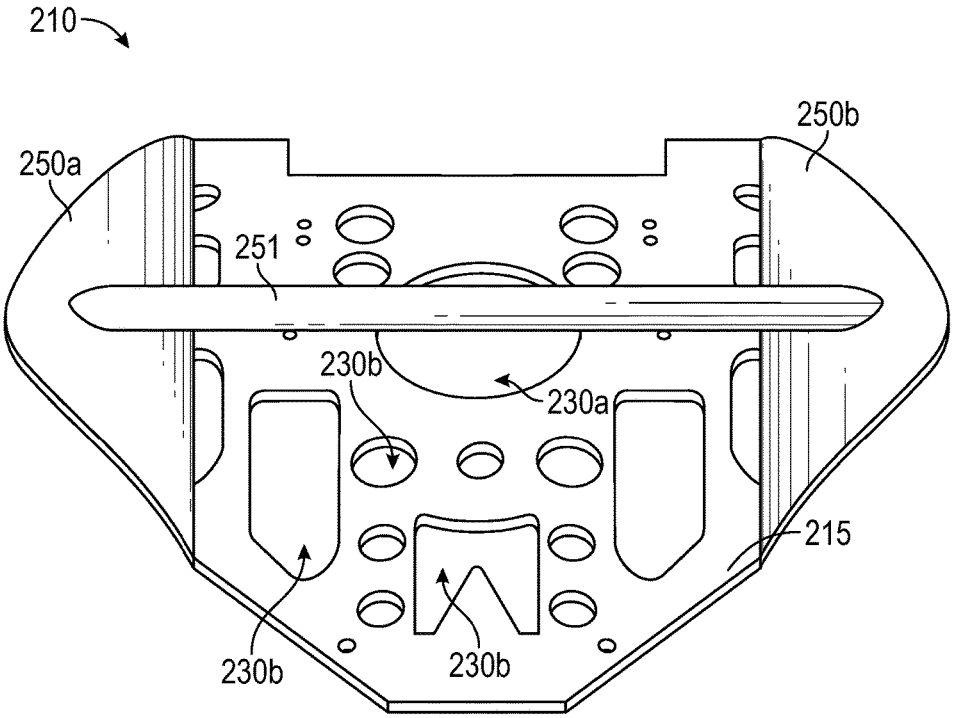
FIGS. 7A and 7B illustrate different views of a shield member in isolation.
Figure 7B:
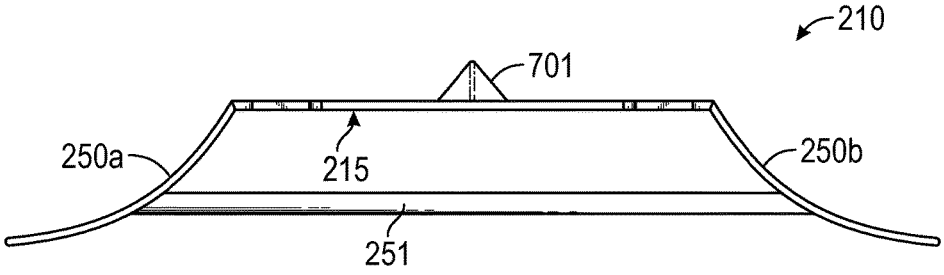

FIGS. 7A and 7B illustrate a non-limiting example of propeller apparatus 210 in isolation. In FIG. 7A, propeller apparatus 210 is shown from a perspective looking directly at the rear side of the propeller shield 215 (e.g., as if viewing the apparatus from behind the boat), whereas, in FIG. 7B, propeller apparatus 210 is shown from a perspective looking down at the top side of propeller shield 215 (e.g., as if standing behind that boat looking down at the propeller while propeller apparatus 210 is in the shielded position). As shown, propeller shield 215 can be substantially flat while wings 250*a* and 250*b* have a forwardly facing concave shape (i.e. the wings' concave side faces towards the propeller/boat). However, in other embodiment, wings 250*a* and 250*b* may be substantially flat rather than concave. As best shown in FIG. 7A, wings 250*a* and 250*b* can have a generally rounded or curved outer profile. However, in other embodiments, the wings' outer profile may come to a point or may have some other general shape. For example, each of FIGS. 2A, 4, and 7A depict a different shape of the wings. In some embodiments, a fin 701 may be optionally formed near a forward-facing bottom edge of the propeller shield 215. Fin 701 can assist in causing propeller apparatus 210 to ride at or near the surface of the water when propeller shield 215 is not secured in the plow position.

While specific embodiments of the present invention have been illustrated and described, numerous modifications come to mind without significantly departing from the spirit of the invention, and the scope of protection is only limited by the scope of the accompanying claims and not by any of the aforementioned embodiments or examples.

The invention claimed is:

1. A propeller apparatus for enhancing the size of a wake produced by a motor boat comprising:

a propeller shield that is sized and shaped to cover a distal face of a boat propeller, the propeller shield having a first side that faces forwardly towards the propeller and a second side that faces rearwardly away from the propeller;

a connection mechanism that couples the propeller shield to the boat via a pivoting connection thereby allowing the propeller shield to pivot between a shielded position in which the propeller shield covers the distal face of the boat propeller and a raised position in which the propeller shield rides at or on the surface of the water;

wings which extend outwardly from opposing sides of the propeller shield; and a connecting member for retaining the propeller shield in a plow position, the plow position being between the shielded position and the raised position such that propeller shield remains behind and substantially inline with the propeller.

2. The propeller apparatus of claim 1, wherein the propeller shield includes a number of openings.

3. The propeller apparatus of claim 2, wherein the openings include a larger central opening and a number of smaller openings spaced around the central opening.

4. The propeller apparatus of claim 1, wherein the wings also extend rearwardly from the opposing sides of the propeller shield.

5. The propeller apparatus of claim 4, wherein the wings have a forwardly-facing concave surface.

6. The propeller apparatus of claim 4, wherein the wings have a rounded outer profile.

7. The propeller apparatus of claim 1, wherein the connection mechanism comprises parallel bars, the propeller apparatus further comprising:

a reinforcing bar that extends between the parallel bars.

8. The propeller apparatus of claim 1, further comprising:

a reinforcing bar that is coupled to and extends between the wings.

9. The propeller apparatus of claim 1, further comprising:

a propeller guard that is configured to be positioned around the propeller.

10. The propeller apparatus of claim 9, wherein the connecting member is coupled between the propeller shield and the propeller guard.

11. The propeller apparatus of claim 10, wherein the propeller shield includes a first connecting structure to which the connecting member couples.

12. The propeller apparatus of claim 11, wherein the propeller guard includes a second connecting structure to which the connecting member couples.

13. The propeller apparatus of claim 12, wherein one or both of the first and second connecting structures are configured to selectively couple to the connecting member.

14. The propeller apparatus of claim 12, wherein the propeller guard includes bracket that is configured to secure the propeller guard to the boat, the bracket being positioned on a bottom side of the propeller guard, the second connecting structure being formed on the bracket.

15. The propeller apparatus of claim 11, wherein the propeller shield includes a reinforcing member at a bottom edge of the propeller shield, the first connecting structure being formed on the reinforcing member.

16. The propeller apparatus of claim 10, wherein the connecting member has a length that causes a bottom edge of the propeller shield to be spaced at least five inches from the propeller guard when the propeller shield is in the plow position.

17. The propeller apparatus of claim 16, wherein the length of the connecting member causes the bottom edge of the propeller guard to be spaced less than ten inches from the propeller guard when in the plow position.

18. The propeller apparatus of claim 10, wherein the connecting member is a chain.

19. A propeller apparatus for enhancing the size of a wake produced by a motor boat comprising:

a propeller guard that is configured to extend around a boat propeller;

a propeller shield that is sized and shaped to overlap the propeller guard;

a connection mechanism that couples the propeller shield to the boat via a pivoting connection thereby allowing the propeller shield to pivot between a shielded position in which the propeller shield is adjacent the propeller guard and a raised position in which the propeller shield rides at or on the surface of the water;

wings which extend outwardly from opposing sides of the propeller shield; and a connecting member for retaining the propeller shield in a plow position, the plow position being between the shielded position and the raised position such that propeller shield remains behind and substantially inline with the propeller.

20. A propeller apparatus for enhancing the size of a wake produced by a motor boat comprising:

a propeller shield that is sized and shaped to cover a distal face of a boat propeller;

a connection mechanism that couples the propeller shield to the boat via a pivoting connection thereby allowing the propeller shield to pivot between a shielded position in which the propeller shield covers the distal face of the boat propeller and a raised position in which the propeller shield rides at or on the surface of the water;

wings which extend outwardly from opposing sides of the propeller shield; and a connecting member that is configured to selectively limit the upward pivoting of the propeller shield to thereby retain the propeller shield in a plow position in which the propeller shield is spaced from but inline with the propeller.

* * * * *